US006238758B1

(12) United States Patent
Lin

(10) Patent No.: US 6,238,758 B1
(45) Date of Patent: May 29, 2001

(54) FLEXIBLE PLATE DEVICE

(76) Inventor: Tsong-Yow Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/252,651

(22) Filed: Feb. 19, 1999

(51) Int. Cl.[7] ..... A47B 13/00; A47B 47/04

(52) U.S. Cl. ..... 428/36.9; 428/35.7; 108/29; 108/57.28; 108/147.12; 108/161; 108/180; 211/134; 211/135; 211/153; 211/188

(58) Field of Search ..... 428/36.9, 36.92, 428/35.7, 34.1; 108/29–30, 147.12, 190, 180, 161, 57.28; 211/188, 153, 134, 135; 312/265.2, 111

(56) References Cited

U.S. PATENT DOCUMENTS

| | | | | |
|---|---|---|---|---|
| D. 329,559 | * | 9/1992 | Paul | D6/524 |
| D. 370,956 | * | 6/1996 | Pery | D21/237 |
| D. 406,199 | * | 3/1999 | Liu | D6/387 |
| 3,964,810 | * | 6/1976 | Murphy | 312/265.2 |
| 4,333,978 | * | 6/1982 | Kocher | 428/158 |
| 5,688,075 | * | 11/1997 | Gradek | 405/63 |

* cited by examiner

*Primary Examiner*—Rena L. Dye

(57) ABSTRACT

A flexible plate device has a plastic plate and two connection bars. Two sets of spaced linear grooves are formed on two ends of the plastic plate. Each of the connection bars is disposed on the respective end of the plastic plate and enclosed by the respective set of the spaced linear grooves. Each of the connection bars has a threaded hole.

4 Claims, 10 Drawing Sheets

FLEXIBLE PLATE DEVICE

BACKGROUND OF THE INVENTION

The present invention relates to a flexible plate device. More particularly, the present invention relates to a flexible plate device which can be bent.

A conventional hard plate cannot be bent at all. The user has to buy many conventional hard plates in order to form a shelf.

SUMMARY OF THE INVENTION

An object of the present invention is to provide a flexible plate device which can be bent to form various shapes.

Accordingly, a flexible plate device comprises a plastic plate and two connection bars. Two sets of spaced linear grooves are formed on two ends of the plastic plate. Each of the connection bars is disposed on the respective end of the plastic plate and enclosed by the respective set of the spaced linear grooves. Each of the connection bars has a threaded hole. Each of the connectin bars and the respective end of the plastic plate are adhered together by a high frequency method.

DETAILED DESCRIPTION OF THE INVENTION

Figure 1:
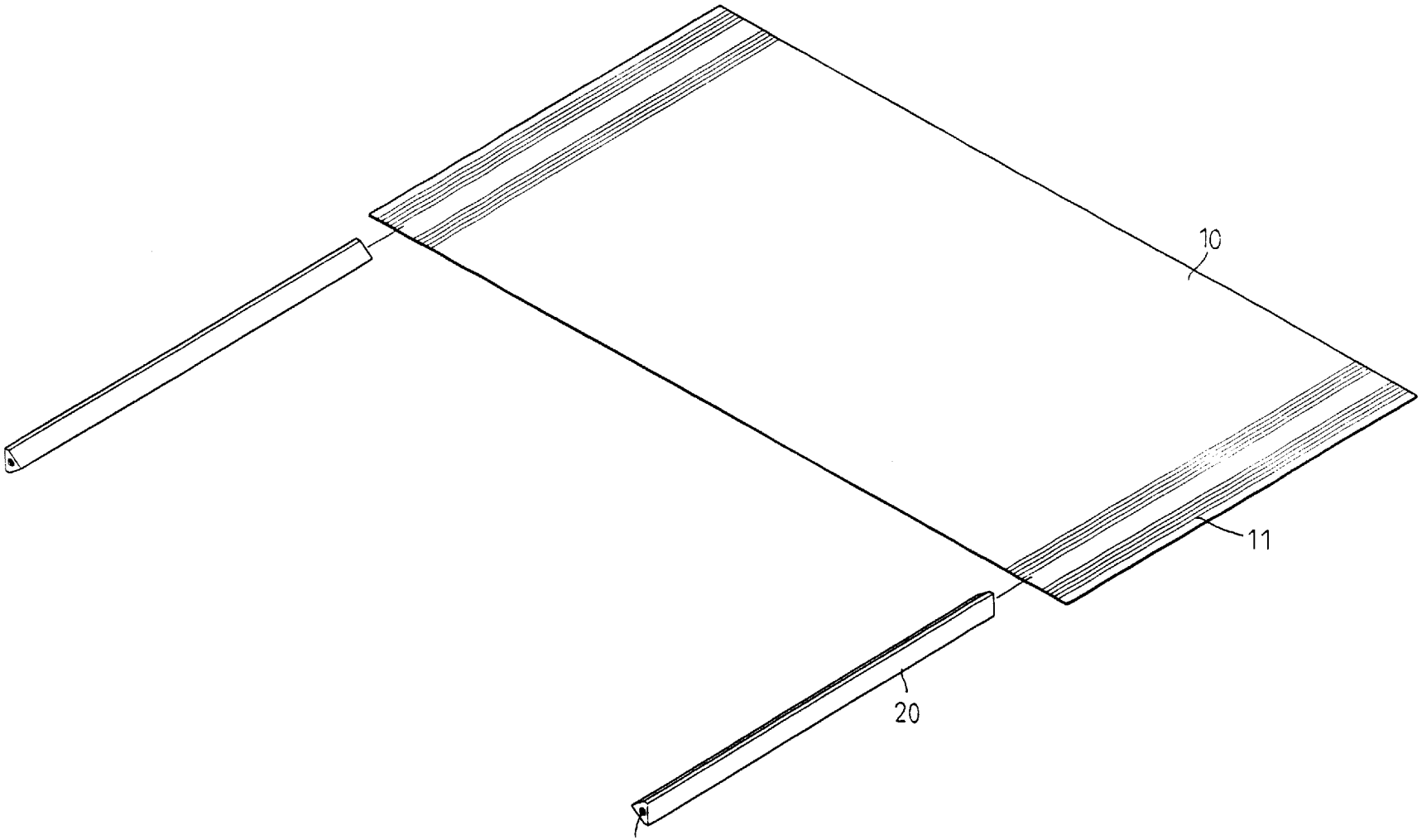
FIG. 1 is a perspective exploded view of a flexible plate device of a first preferred embodiment in accordance with the present invention.
Figure 2:
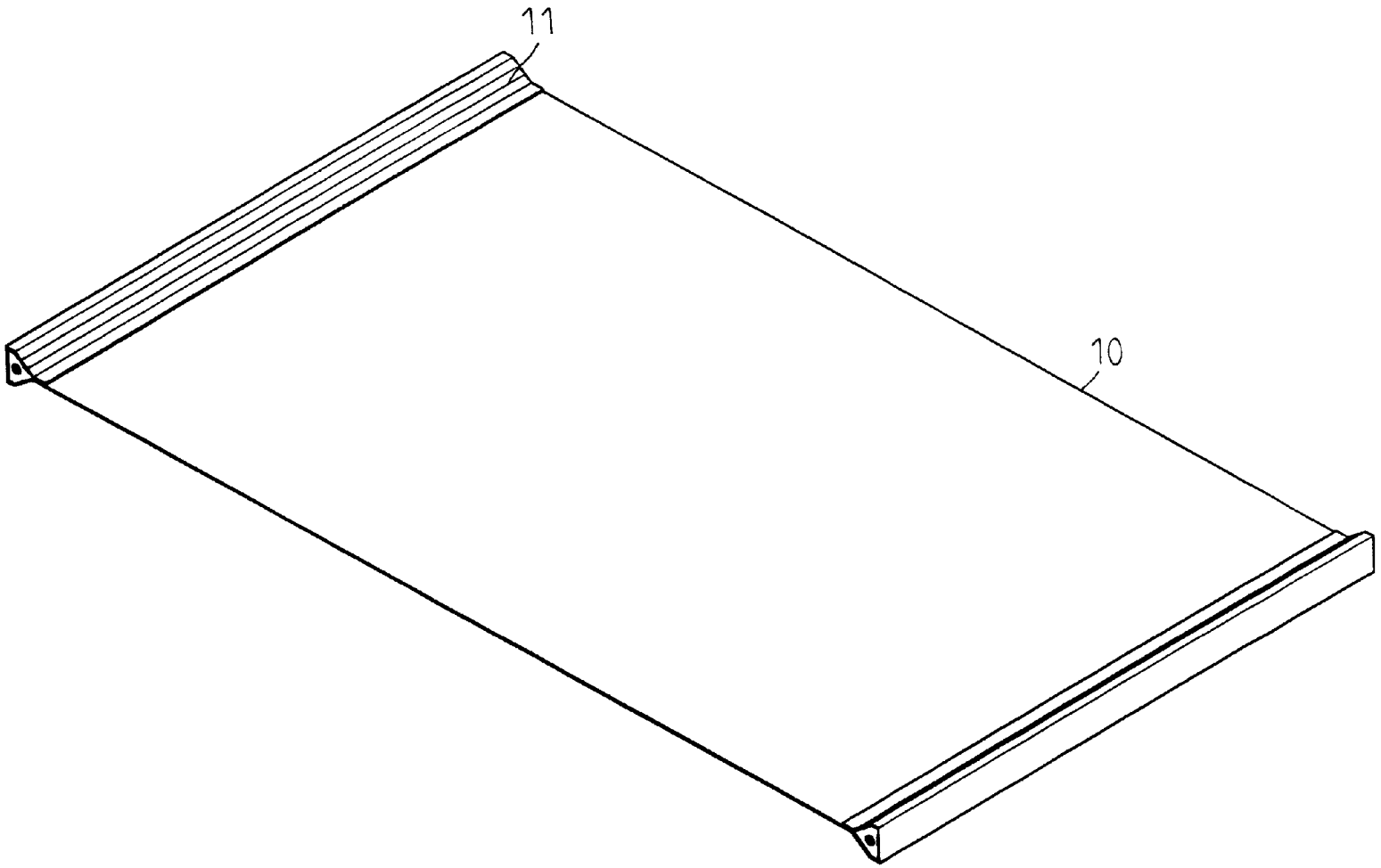
FIG. 2 is a perspective assembly view of a flexible plate device of a first preferred embodiment in accordance with the present invention.

Referring to FIGS. 1 and 2, a first flexible plate device comprises a plastic plate 10 and two connection bars 20.

Two sets of spaced linear grooves 11 are formed on two ends of the plastic plate 10. Each of the connection bars 20 is disposed on the respective end of the plastic plate 10 and enclosed by the respective set of the spaced linear grooves 11. Each of the connection bars 20 has a triangular cross-section. Each of the connection bars 20 has a threaded hole 21.

Each of the connection bars 20 and the respective end of the plastic plate 10 are adhered together by a high frequency method.

Figure 3:
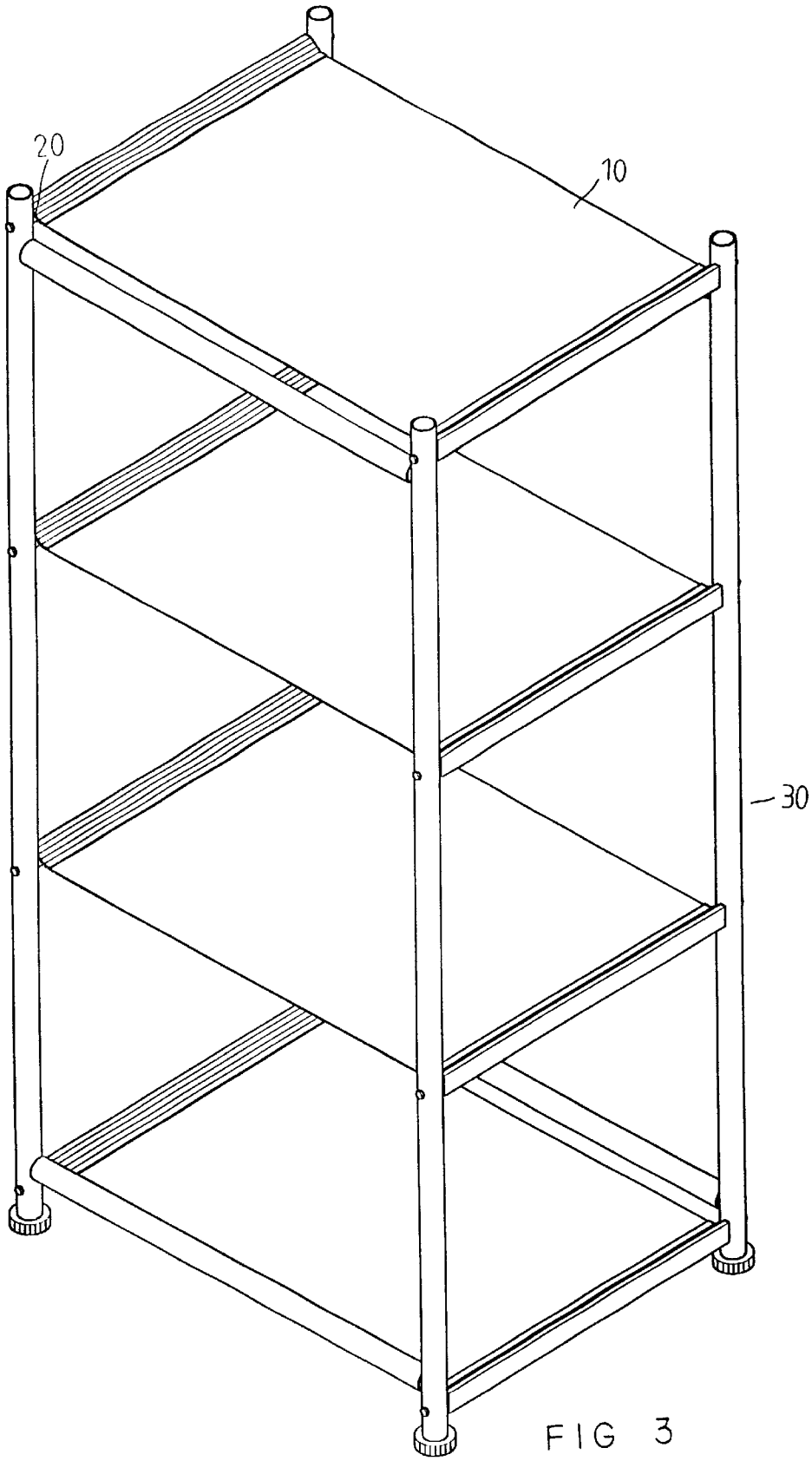
FIG. 3 is a perspective assembly view of a plurality of flexible plate devices of a first preferred embodiment disposed on a frame.

Referring to FIG. 3, a plurality of first flexible plate devices are disposed on a frame 30.

Figure 4:
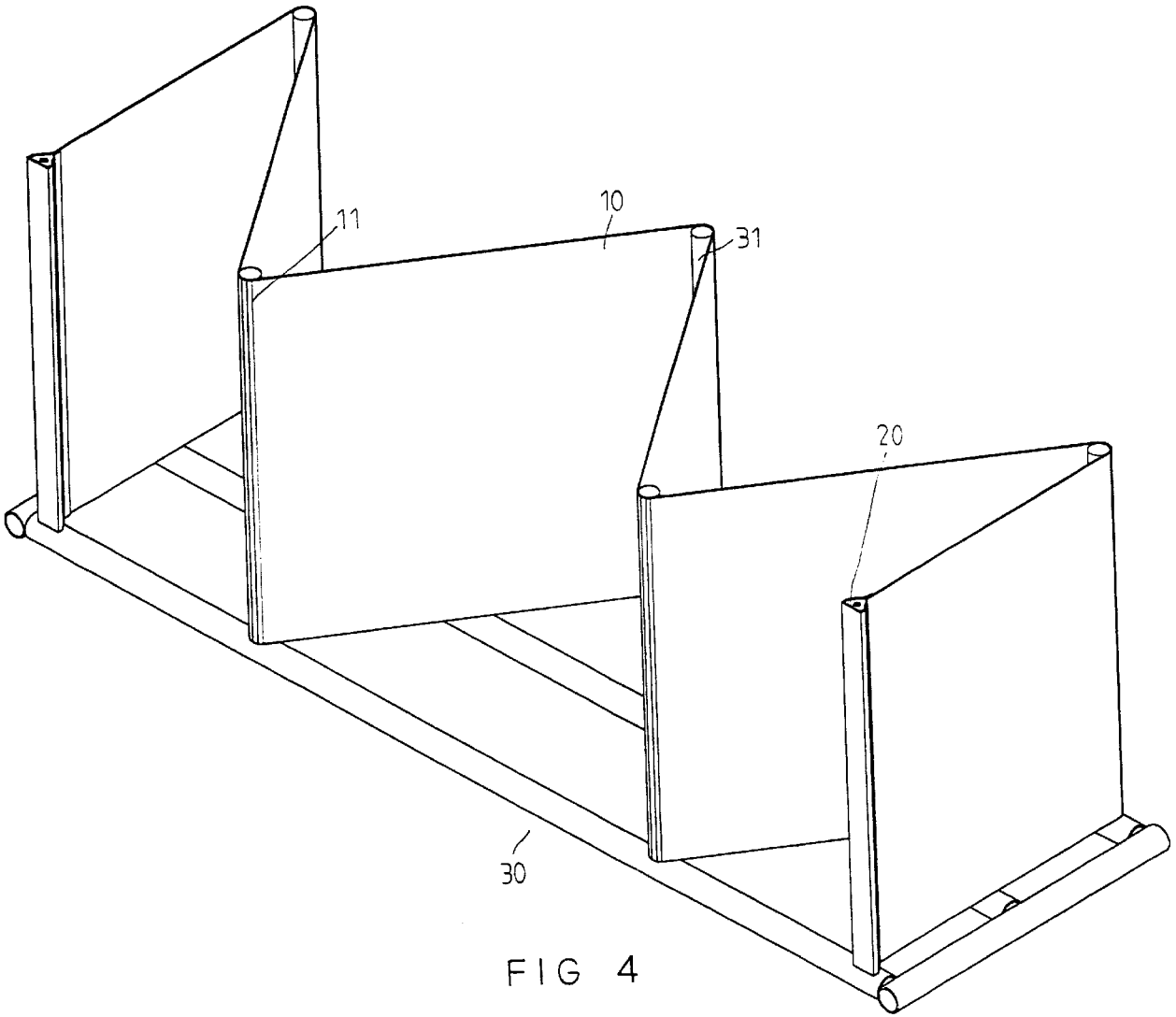
FIG. 4 is a schematic view illustrating a first application of a flexible plate device of a first preferred embodiment in accordance with the present invention.

Referring to FIG. 4, additional spaced linear grooves 11 are formed on the plastic plate 10 to surround a rod 31. The plastic plate 10 is disposed on a frame 30.

Figure 5:
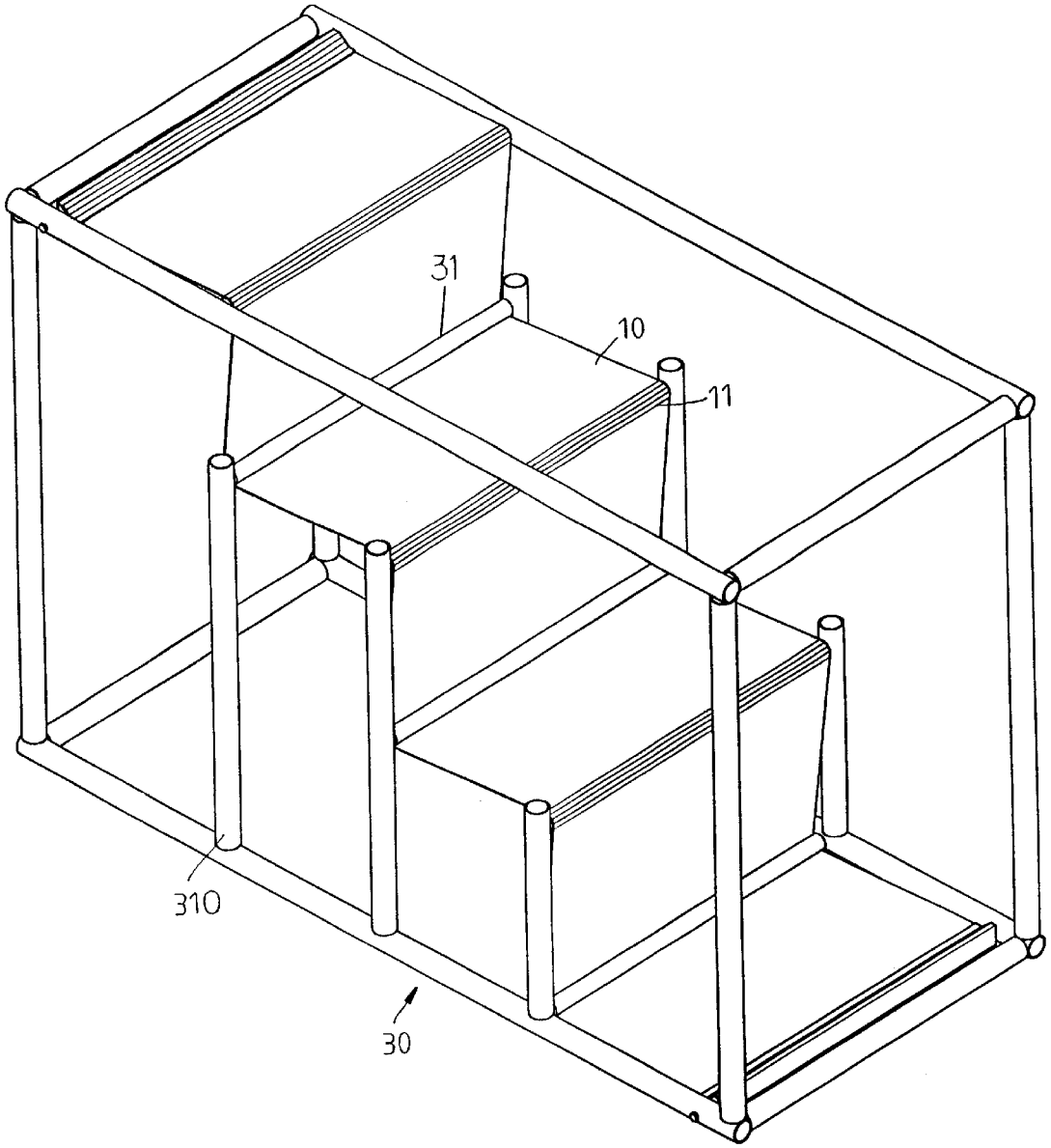
FIG. 5 is a schematic view illustrating a second application of a flexible plate device of a first preferred embodiment in accordance with the present invention.

Referring to FIG. 5, additional spaced linear grooves 11 are formed on the plastic plate 10 to surround a rod 31. A frame 30 has two support posts 310 to support the rod 31.

Figure 6:
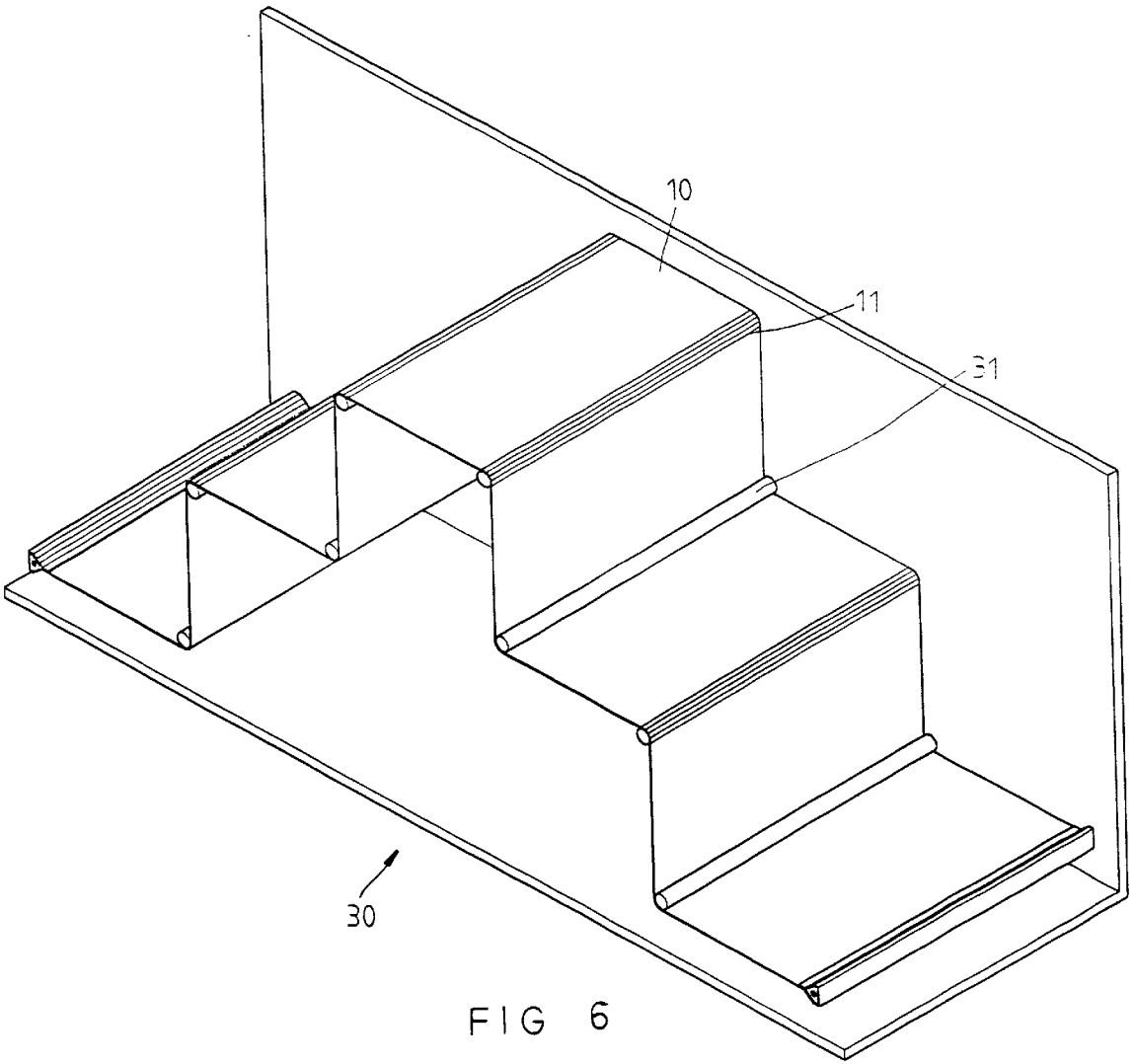
FIG. 6 is a schematic view illustrating a third application of a flexible plate device of a first preferred embodiment in accordance with the present invention.

Referring to FIG. 6, additional spaced linear grooves 11 are formed on the plastic plate 10 to surround a rod 31.

Figure 7:
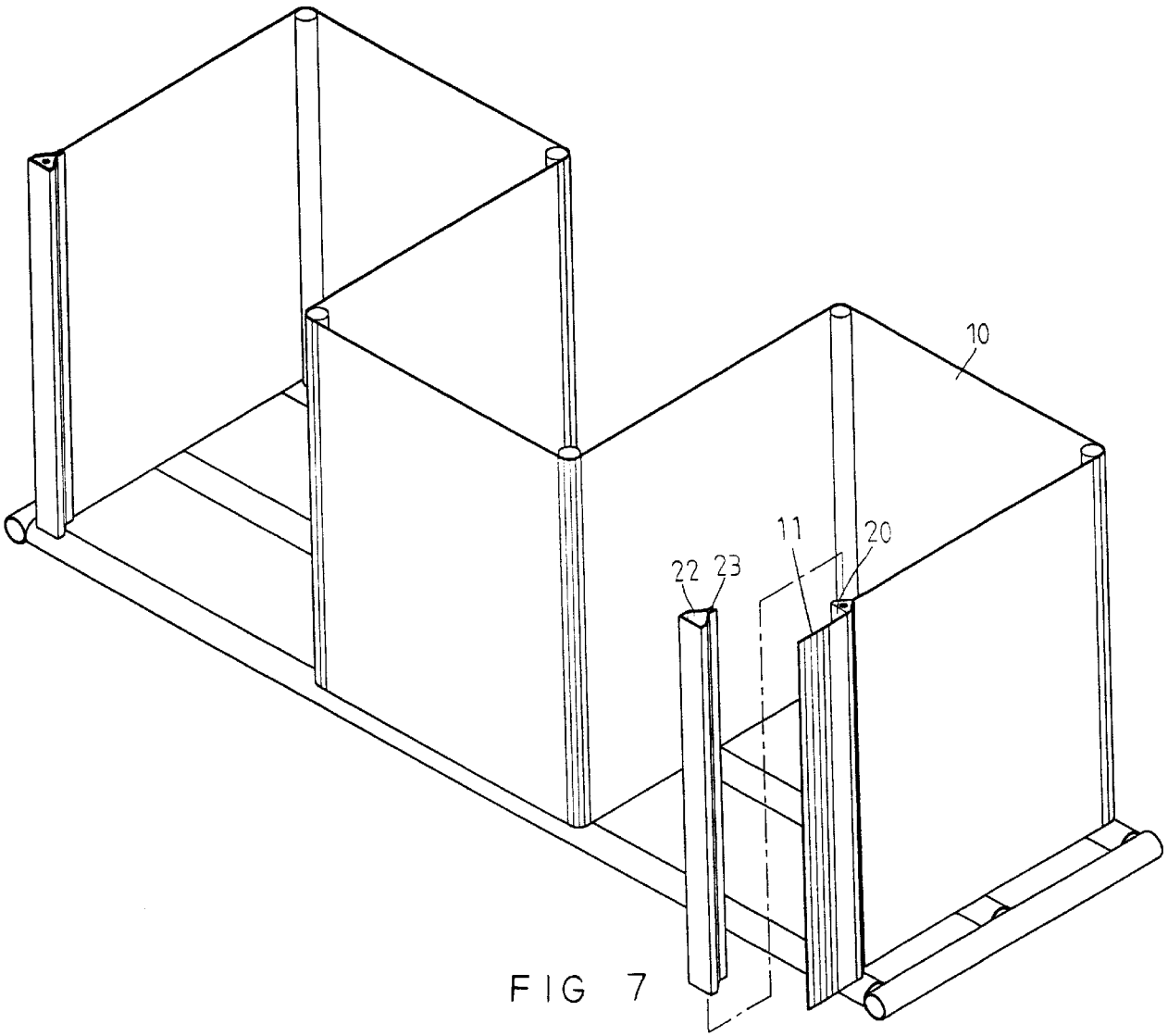
FIG. 7 is a perspective view of a flexible plate device of a second preferred embodiment in accordance with the present invention.

Referring to FIG. 7, a second flexible plate device comprises a plastic plate 10 and two connection bars 20. Each of the connection bars 20 is enclosed by a hollow casing 22. The hollow casing 22 has a slot 23. Two sets of spaced linear grooves 11 are formed on two ends of the plastic plate 10. Each hollow casing 22 is disposed on the respective end of the plastic plate 10 and enclosed by the respective set of the spaced linear grooves 11. Each of the connection bars 20 has a triangular cross-section.

Figure 8:
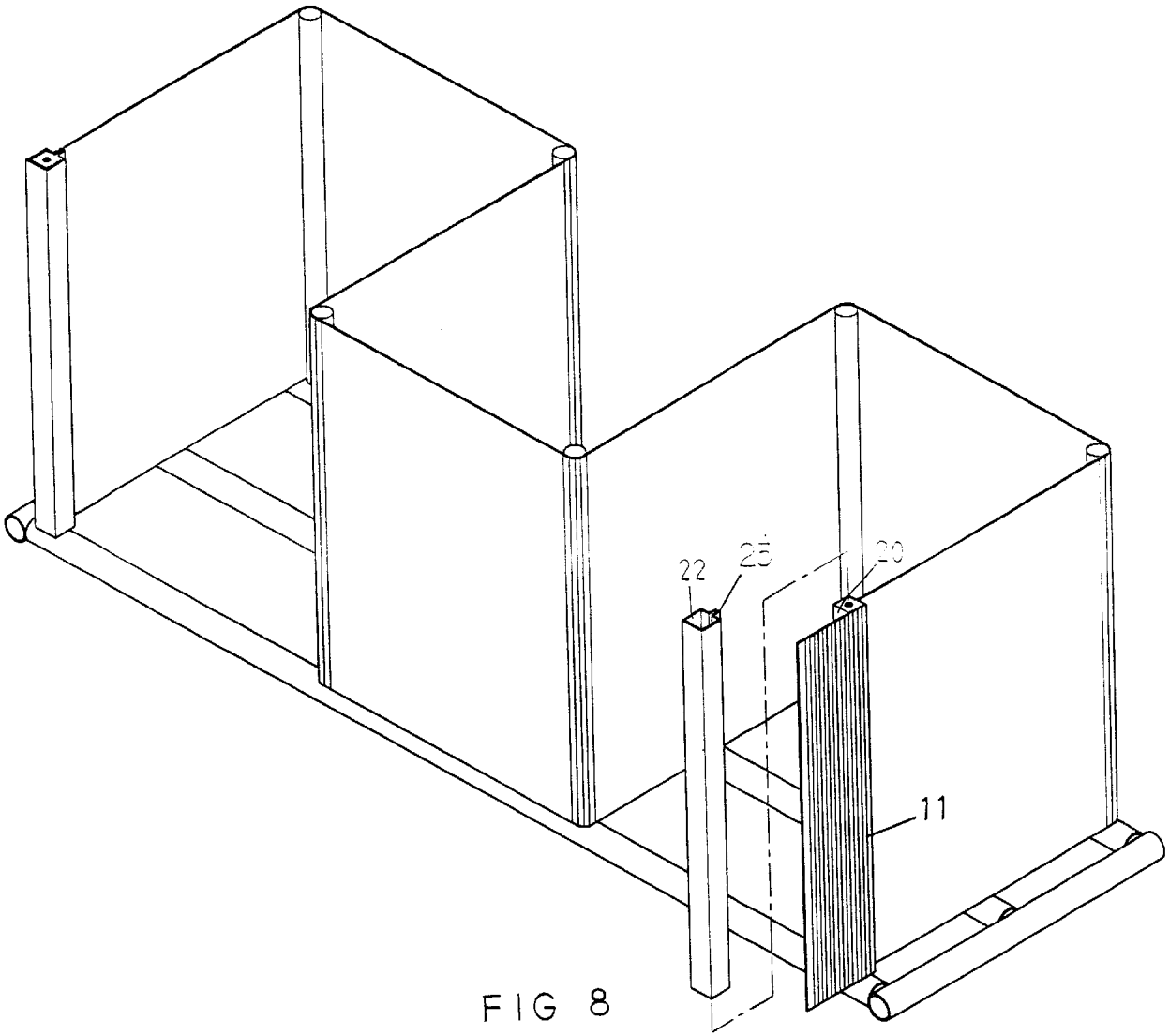
FIG. 8 is a perspective view of a flexible plate device of a third preferred embodiment in accordance with the present invention.

Referring to FIG. 8, a third flexible plate device comprises a plastic plate 10 and two connection bars 20. Each of the connection bars 20 is enclosed by a hollow casing 22. The hollow casing 22 has a slot 23. Two sets of spaced linear grooves 11 are formed on two ends of the plastic plate 10. Each hollow casing 22 is disposed on the respective end of the plastic plate 10 and enclosed by the respective set of the spaced linear grooves 11. Each of the connection bars 20 has a square cross-section.

Figure 9:
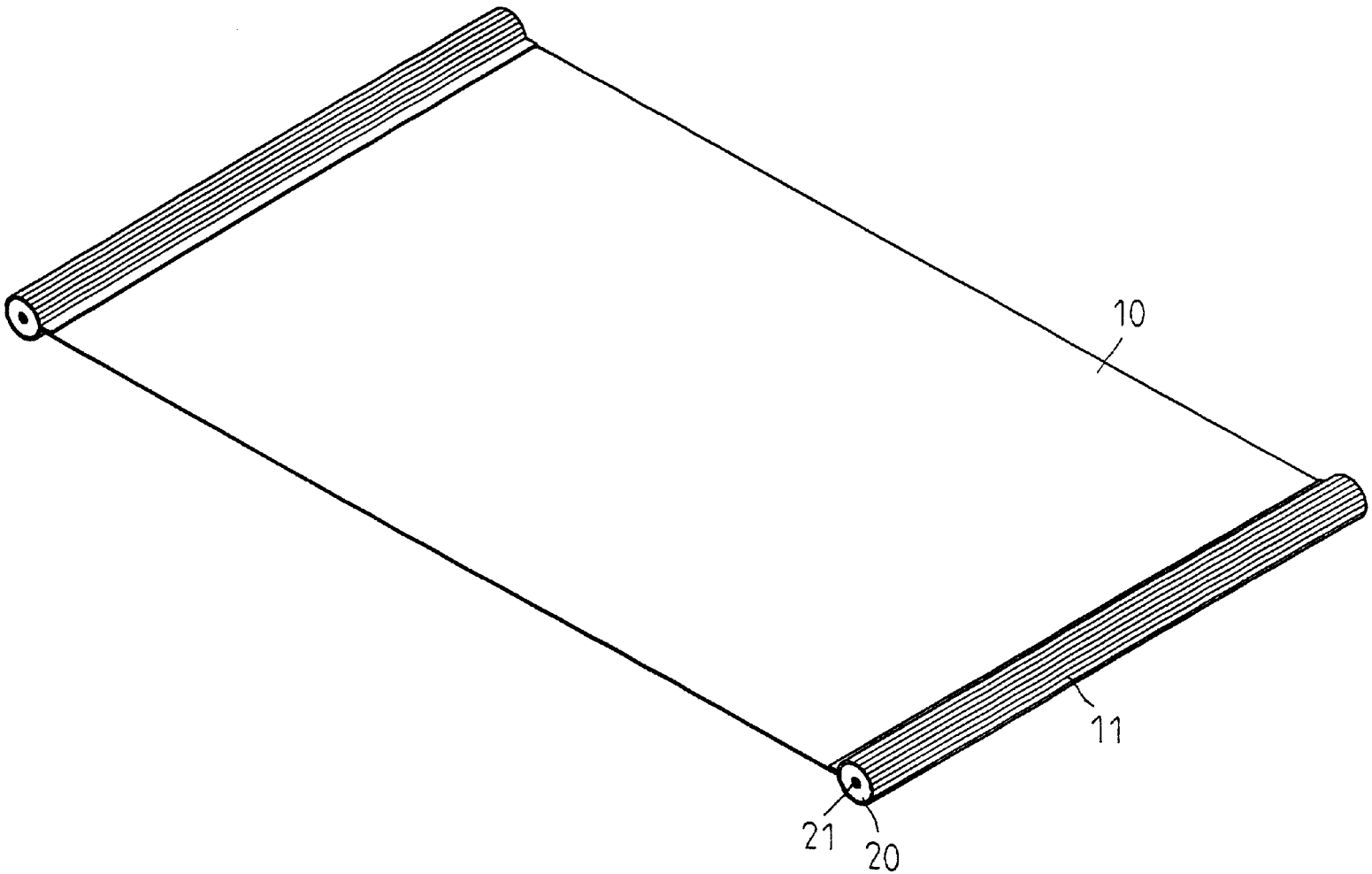
FIG. 9 is a perspective view of a flexible plate device of a fourth preferred embodiment in accordance with the present invention.

Referring to FIG. 9, a fourth flexible plate device comprises a plastic plate 10 and two connection rods 20. Two sets of spaced linear grooves 11 are formed on two ends of the plastic plate 10. Each of the connection rods 20 is disposed on the respective end of the plastic plate 10 and enclosed by the respective set of the spaced linear grooves 11. Each of the connection rods 20 has a round cross-section. Each of the connection rods 20 has a threaded hole 21.

Figure 10:
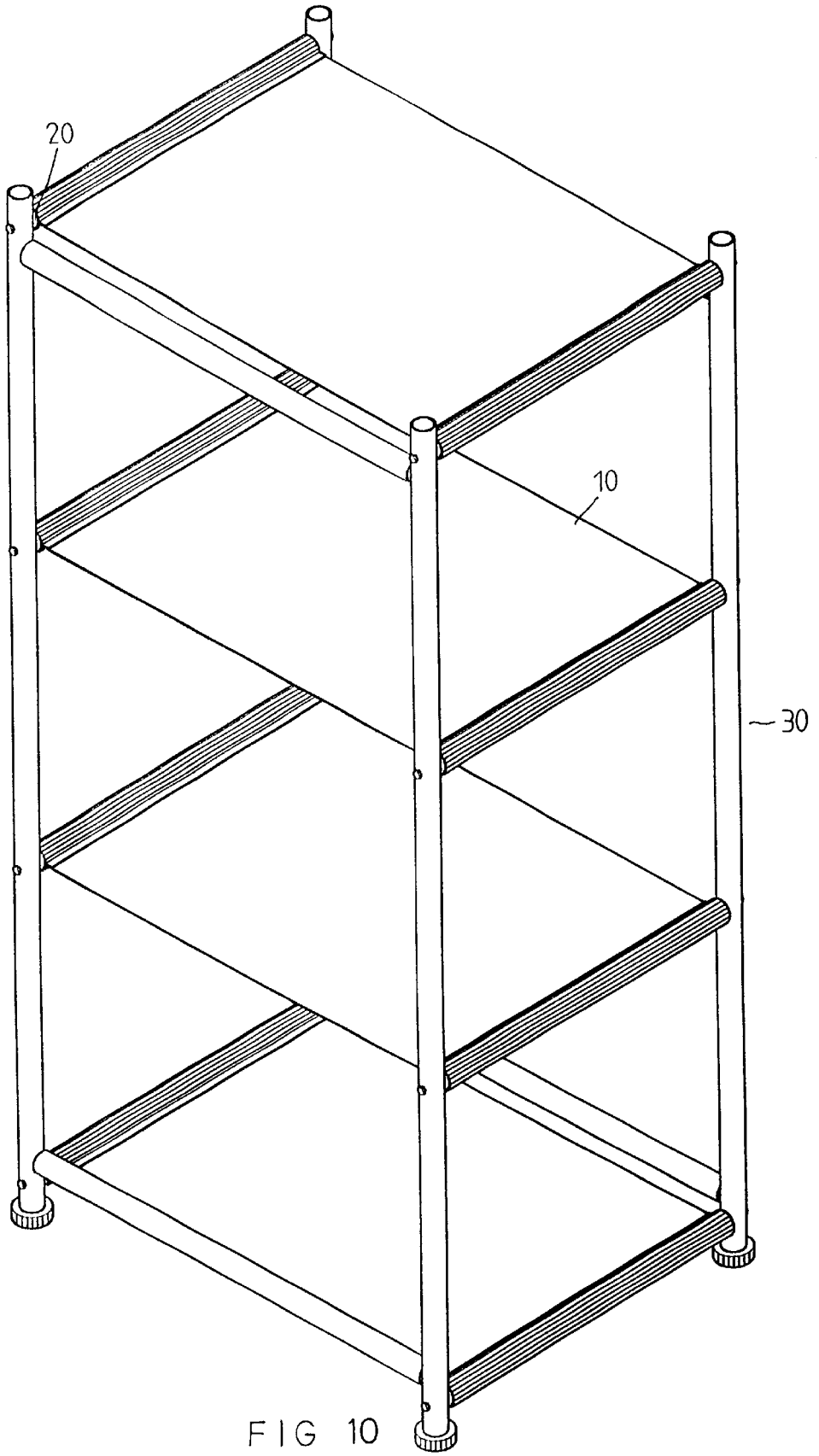
FIG. 10 is a perspective assembly view of a plurality of flexible plate devices of a fourth preferred embodiment disposed on a frame.

Referring to FIG. 10, a plurality of fourth flexible plate devices are disposed on a frame 30.

The present invention is not limited to the above embodiments but various modification thereof may be made. Furthermore, various changes in form and detail may be made without departing from the scope of the present invention.

I claim:

1. A flexible plate device comprises:

a plastic plate and two connection bars, two sets of spaced linear grooves formed on two ends of the plastic plate, each of the connection bars disposed on the respective ends of the plastic plate and enclosed by the respective set of the spaced linear grooves, each of the connection bars having a threaded hole, and each of the connection bars and the respective ends of the plastic plate adhered together by a high frequency method.

2. A flexible plate device as claimed in claim 1, wherein each of the connection bars has a triangular cross-section.

3. A flexible plate device as claimed in claim 1, wherein each of the connection bars has a square cross-section.

4. A flexible plate device as claimed in claim 1, wherein each of the connection bars has a round cross-section.

* * * * *